US009725196B2

(12) United States Patent
Bartoli et al.

(10) Patent No.: US 9,725,196 B2
(45) Date of Patent: Aug. 8, 2017

(54) METHOD FOR MAKING A CAPSULE FOR BEVERAGES AND CAPSULE

(71) Applicant: SARONG SOCIETA' PER AZIONI, Reggiolo (Reggio Emilia) (IT)

(72) Inventors: Andrea Bartoli, Reggio Emilia (IT); Davide Capitini, Reggio Emilia (IT); Alessandro Grillenzoni, Campogalliano (IT); Flavio Traldi, San Prospero (IT)

(73) Assignee: SARONG SOCIETA' PER AZIONI, Reggiolo (Reggio (IT)

( * ) Notice: Subject to any disclaimer, the term of this patent is extended or adjusted under 35 U.S.C. 154(b) by 0 days.

(21) Appl. No.: 14/769,364

(22) PCT Filed: Feb. 20, 2014

(86) PCT No.: PCT/IB2014/059134

§ 371 (c)(1),
(2) Date: Aug. 20, 2015

(87) PCT Pub. No.: WO2014/128647

PCT Pub. Date: Aug. 28, 2014

(65) Prior Publication Data

US 2016/0001903 A1 Jan. 7, 2016

(30) Foreign Application Priority Data

Feb. 22, 2013 (IT) ..... MO2013A0046

(51) Int. Cl.
*B65B 29/02* (2006.01)
*B65B 61/18* (2006.01)
(Continued)

(52) U.S. Cl.
CPC ..... *B65B 29/02* (2013.01); *B65B 7/2842* (2013.01); *B65B 61/18* (2013.01); *B65D 85/8043* (2013.01); *B65D 2565/385* (2013.01)

(58) Field of Classification Search
CPC ..... B65B 29/02; B65B 7/2842
(Continued)

(56) References Cited

U.S. PATENT DOCUMENTS 3,292,527 A * 12/1966 Stasse ..... A47J 31/0673 222/541.3
5,125,327 A * 6/1992 Winnington-Ingram ..... A47G 19/14 99/306

(Continued)

FOREIGN PATENT DOCUMENTS

| | | |
|---|---|---|
| EP | 2093148 A1 | 8/2009 |
| WO | 2011047836 A1 | 4/2011 |
| WO | 2013008012 A2 | 1/2013 |

OTHER PUBLICATIONS

International Search Resport & Written Opinion of hte International Searching Authority Application No. PCT/IB2014/059134 Completed Jun. 18, 2014; Mailing Date: Jul. 1, 2014 10 pages.

*Primary Examiner* — Gloria R Weeks
(74) *Attorney, Agent, or Firm* — Whitmyer IP Group LLC

(57) ABSTRACT

A method for making a capsule usable in a brewing machine including the steps of: making a filtering element intended for containing the initial product and having at least one gripping portion; fixing the filtering element to a casing; filling the filtering element with a dose of the initial product; fixing a covering element to the casing to close hermetically inside the cavity the filtering element and the initial product; and reinforcing the gripping portion to enable a user grasping the latter to remove at least the filtering element from the casing after use.

21 Claims, 2 Drawing Sheets

(51) Int. Cl.
*B65D 85/804* (2006.01)
*B65B 7/28* (2006.01)

(58) Field of Classification Search
USPC ..... 426/77, 82; 53/155, 452
See application file for complete search history.

(56) References Cited

U.S. PATENT DOCUMENTS 5,424,083 A * 6/1995 Lozito ..... B65D 85/8043 426/110
5,590,581 A * 1/1997 Strub ..... A47J 31/0663 99/295
5,637,335 A * 6/1997 Fond ..... B65B 29/02 426/111
5,738,786 A * 4/1998 Winnington-Ingram ..... A47G 19/16 206/5
5,971,195 A * 10/1999 Reidinger ..... B65D 51/28 215/227
6,440,256 B1 * 8/2002 Gordon ..... A47J 31/08 156/201
6,959,832 B1 * 11/2005 Sawada ..... B65D 77/206 220/266
8,161,866 B2 * 4/2012 Kollep ..... B65D 85/8043 426/112
8,276,639 B2 * 10/2012 Binacchi ..... B65B 29/02 156/443
8,834,948 B2 * 9/2014 Estabrook ..... A47J 31/407 426/115
9,527,661 B2 * 12/2016 Fu ..... B65D 85/8043
2002/0088807 A1 * 7/2002 Perkovic ..... B65D 85/8043 220/654
2005/0051478 A1 * 3/2005 Karanikos ..... B65D 85/8043 210/469
2007/0131687 A1 * 6/2007 Otto ..... A47G 33/002 220/212
2009/0311389 A1 * 12/2009 Zoss ..... B65D 51/247 426/120
2010/0003379 A1 * 1/2010 Zoss ..... B65D 51/247 426/115
2011/0117248 A1 * 5/2011 Rivera ..... A47J 31/085 426/77
2011/0247975 A1 * 10/2011 Rapparini ..... B65D 65/466 210/321.6
2012/0058226 A1 * 3/2012 Winkler ..... A47J 31/3695 426/79
2012/0097602 A1 * 4/2012 Tedford ..... B65D 65/466 210/500.1
2012/0121764 A1 * 5/2012 Lai ..... A47J 31/3623 426/77
2012/0171334 A1 * 7/2012 Yoakim ..... A47J 31/22 426/87
2012/0210878 A1 * 8/2012 Mariller ..... A47J 31/0668 99/295
2012/0269933 A1 * 10/2012 Rapparini ..... B65D 85/8043 426/82
2013/0259982 A1 * 10/2013 Abegglen ..... B65D 85/8043 426/115
2013/0340626 A1 * 12/2013 Oh ..... B65D 85/8043 99/295
2014/0010926 A1 * 1/2014 Digiuni ..... B65D 85/8043 426/112
2014/0141128 A1 * 5/2014 Trombetta ..... B65B 1/02 426/77
2014/0161936 A1 * 6/2014 Trombetta ..... B65D 85/816 426/77
2014/0174300 A1 * 6/2014 Husband ..... A47J 31/0689 99/323
2015/0056341 A1 * 2/2015 Trombetta ..... B65D 85/8043 426/115
2015/0128525 A1 * 5/2015 Bartoli ..... B29C 51/04 53/410
2015/0166204 A1 * 6/2015 Rea ..... B65B 29/02 53/452
2015/0307267 A1 * 10/2015 Jackson ..... B65D 85/8046 426/115

* cited by examiner

METHOD FOR MAKING A CAPSULE FOR BEVERAGES AND CAPSULE

FIELD OF THE INVENTION

The invention relates to containers or capsules for preparing beverages in brewing machines and in particular relates to a method for making a capsule provided with an internal filtering element intended for containing an initial product to be combined with a liquid for preparing a final product, typically a hot beverage, for example coffee or tea, in a brewing machine. The invention also relates to a capsule.

BACKGROUND OF THE INVENTION

Disposable sealed capsules are known that are provided with an internal filtering element that comprise an external container or casing, made of impermeable plastic material, in the shape of a glass or cup, provided with a bottom wall and a side wall that define a cavity provided with an upper opening. The latter is closed hermetically by a cover so as to internally seal the casing the filtering element, or filter, containing the initial product from which to obtain the final product (beverage) by percolation or infusion. The cover and the bottom wall of the casing are perforable (by a suitable arrangement of the brewing machine) to enable a pressurised liquid, typically water, to be introduced, (generally from above through the cover) and the extraction of the beverage obtained by percolation or infusion (generally from the bottom, via the bottom wall).

The known capsules are made of aluminium or plastics, in the latter case by injection moulding processes or processes of thermoforming single or multilayered plastic sheets.

In one type of capsule for obtaining a final product by percolation or infusion of the initial product, the filter, which is shaped as a bag to make a respective cavity that is open upwards to contain the initial product, is fixed, in particular welded, to the side wall of the casing at an upper peripheral rim thereof that is typically in the shape of a flange. The filter divides the inside of the casing into a first upper chamber containing the product and accessible through the upper opening of the casing (to enable filling) and a second lower chamber, comprised between the filter and the bottom wall and/or the side wall of the casing, which enables the beverage obtained from the initial product to be extracted.

In known machines for making capsules for beverages, the filters are formed separately, by folding portions of suitable dimensions obtained by cutting or shearing a film of filtering material unwound from a reel. The formed filters are then inserted into and fixed to respective previously formed capsules.

The filters generally have a conical or frustoconical shape with smooth or pleated or folded walls so as to increase the passage surface of the fluid.

The known filtering elements are generally made of filter paper, a material that is permeable to liquids, light and thin that can be easily cut.

SUMMARY OF THE INVENTION

Filtering elements are also known that are made with films or sheets of non-woven material, which has stratified or crossed fibres, joined together mechanically, with adhesives or with thermal processes. The fibres comprise threads of synthetic material and/or plastics, typically threads of polyester, polypropylene, polyamide. Although the filters made of non-woven material ensure the same performance as the filter paper in terms of filtration, they are more resistant mechanically, in particular to traction.

Following the demand for solid urban waste sorting, the need to dispose of the capsules has recently emerged that were once used in the brewing machines, separating the components thereof on the basis of the material with which they are made, in particular dividing the external casing into plastics or metal (aluminium) from the internal filter containing the initial organic product and possibly from the cover made of plastics or metal.

The removal of the bag filters in the known capsules is nevertheless very complex and difficult, as the filter is not only not graspable directly by the user but is also welded to the walls or to the rim of the casing and can easily become torn or broken when it is detached, releasing the initial product contained therein, generally at high temperature, this causing hazards for the safety of the user and problems of hygiene and cleanliness.

This drawback occurs independently of the filtering material used for making the filter, i.e. using both filter paper and non-woven material. In effect, it is observed that the wet filtering material at the welding zones tends to tear when subjected to traction to detach the filter from the casing.

An object of the present invention is to improve the known capsules to prepare beverages in brewing machines and the known methods for making the aforesaid capsules, in particular capsules provided with filtering elements suitable for containing an initial product from which to obtain a final product, typically a beverage, by means of percolation or infusion with a liquid.

Another object is to provide a capsule and a corresponding manufacturing method provided with a filtering element that can be firmly fixed to a casing of the capsule, so as not to be detached in use and which at the same time can be easily detached and removed from the casing by a user during disposal of the capsule after use.

In a first aspect of the invention a method is provided for making a capsule according to claim 21.

In a second aspect of the invention a capsule for beverages is provided according to claim 33.

BRIEF DESCRIPTION OF THE DRAWINGS

The invention can be better understood and implemented with reference to the attached drawings that illustrate some embodiments thereof by way of non-limiting example, in which.

DETAILED DESCRIPTION OF THE INVENTION

Figure 1:
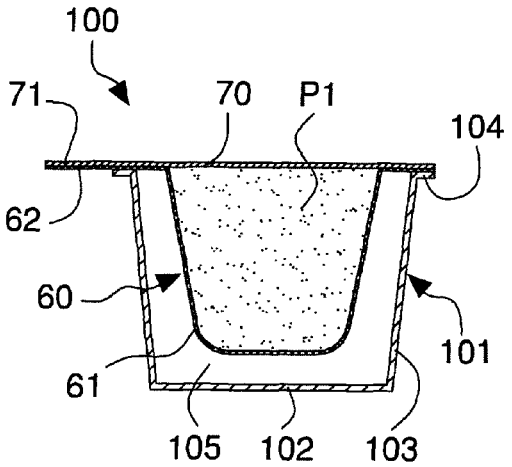
FIG. 1 is a schematic cross section of a capsule provided with a filtering element according to the invention and in an assembled configuration.
Figure 2:
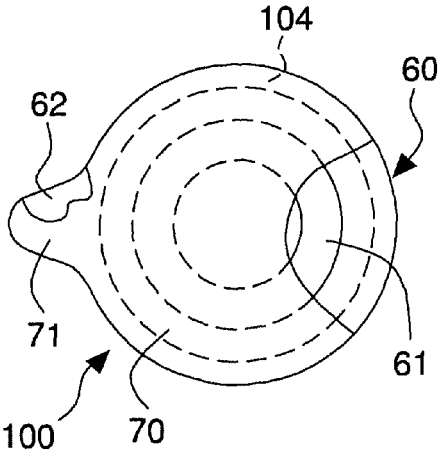
FIG. 2 is a plan view of the capsule in FIG. 1.

With reference to FIG. 1, a capsule 100 is illustrated comprising a casing 101 provided with a base wall 102 and with a side wall 103 defining a cavity 105 suitable for containing a filtering element 60 and an initial product P1 from which to obtain a final product using the aforesaid capsule in a brewing machine.

The filtering element 60 is made of non-woven material of known type containing fibres of synthetic material and/or plastics such as nylon, polyester, polyethylene, polypropylene, polyamide that are joined together, braided and/or superimposed, by mechanical thermal processes or by coupling with binding substances.

The capsule 100 further comprises a covering element 70 formed, for example, of a film of plastics or metal and fixed to a flange rim 104 of the casing 101 to close the cavity 105 hermetically, and more precisely to enclose in the cavity 105 the filtering element 60 and the dose of initial product P1 that it contains.

The filtering element 60 is fixed to the rim 104 and comprises a central portion 61 intended for containing the initial product P1 and at least one gripping portion 62 that protrudes externally from the casing 101, and in particular extends externally starting from the rim 104 of the casing 101. Alternatively, the filtering element 60 can be fixed to the side wall 103 or to the latter and to the rim 104.

The filtering element 60 in the illustrated embodiment comprises a central portion 61 having a plan shape corresponding to the shape, for example circular, of the rim 104 of the casing, and a tab-shaped gripping portion 62 that extends radially from said central portion 61. On the latter there is formed, for example by the process of stretching and drawing non-woven material, a respective cavity intended for containing a dose of initial product P1.

An annular zone of the central portion 61 is fixed, in particular thermally welded, to the rim 104 of the casing 101.

Figure 3:
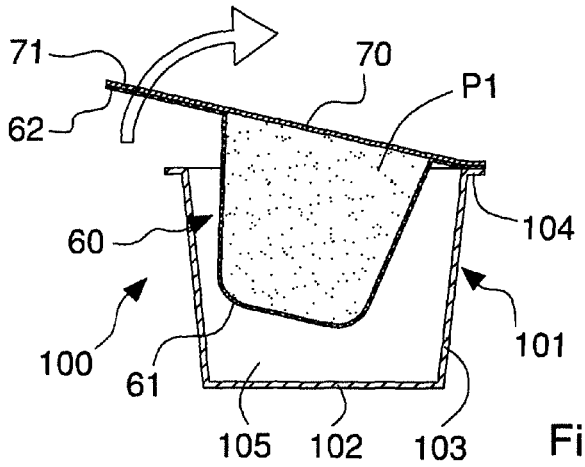
FIG. 3 is a cross section of the capsule in FIG. 1 in a detachment and partial removal configuration of the filtering element.

To reinforce the gripping portion 62 and enable a user gripping the latter to remove and detach at least the filtering element 60 from the casing 101 after using the capsule 100 in the brewing machine, it is provided that the covering element 70 comprises at least one cover portion 71 arranged for being superimposed and associated with the gripping portion 62 of the filtering element 60. In particular, the cover portion 71 is fixed, for example welded thermally or by ultrasound, to the gripping portion 62. In this manner, it is possible for the user to grasp together the gripping portion 62 and the cover portion 71 and detach and remove from the casing 101 the filtering element 60 and the covering element 70. The cover portion 70 confers resistance to traction and to tearing on the gripping portion 62 of the filtering element 60, preventing it being able to tear or get detached from the central portion 61, fixed to the rim 104 of the casing, during detachment of the filtering element (FIG. 3).

It is thus possible, after use of the capsule 100 in a brewing machine, to separate easily and effectively the filtering element 60, containing the initial organic product P1, from the casing 101 made of plastics of the capsule 101, so as to perform sorting of solid urban waste.

Figure 4:
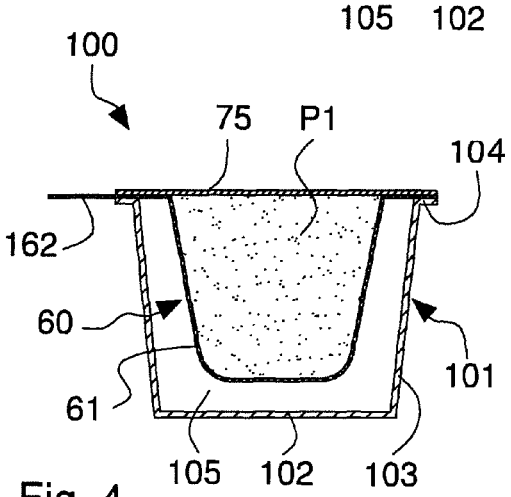
FIG. 4 is a cross section of a version of the capsule of the invention and in an assembled configuration.
Figure 5:
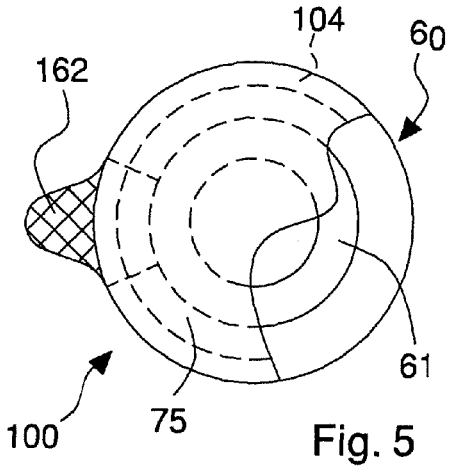
FIG. 5 is a plan view of the capsule in FIG. 4.

FIGS. 4 and 5 illustrate a version of the capsule 100 of the invention that differs through the fact that the filtering element 60 comprises a gripping portion 162 that is treated thermally and mechanically by hot pressure so that it comprises at least one external surface layer of the non-woven material in which fibres of the latter are compacted and pressed together and has a thickness of said non-woven material reduced by a percentage comprised between 30 and 50%. In other words, the non-woven material at the gripping portion 62 is treated to vary the physical-mechanical features thereof.

Preferably, the hot-pressed gripping portion 162 comprises two external and opposite surface layers in the fibres are compacted and pressed together. The fibres are substantially alongside and brought next to one another with a substantially reduction of the passages (pores) between adjacent fibres.

Further, the fibres of the two surface layers are joined by partial fusion and resulting adhesion of the aforesaid fibres during the hot press step.

As explained in detail further on in the description, in the hot-pressed gripping portion 162 the non-woven material has different physical and mechanical features from those of the original non-woven material (central portion 61). More precisely, through the effect of the compacting and partial joining (partial and surface fusion) of the fibres of the surface layers of the non-woven material, in the hot-pressed gripping portion 62, in addition to a decrease in the thickness, greater density, greater resistance to traction, to penetration and to cutting and less permeability to liquids of the material are observed. The greater resistance to traction and to penetration also determines greater compliance and elastoplastic elongation of the non-woven material.

The greater resistance to traction and the lesser compliance of the non-woven material at the hot-pressed gripping portion 162 thus enable a user to grasp the aforesaid gripping portion 162 and pull the gripping portion 162 to detach and remove the filtering element 60 from the casing 101, without the risk that the aforesaid gripping portion 162 can become torn or detached from the central portion 61 fixed to the rim 104 of the casing.

Also in this case it is possible, after using the capsule 100 in a brewing machine, to separate the filtering element 60 containing the initial organic product P1 from the casing 101 made of plastics of the capsule 101 easily and effectively, so as to meet the requirements for the sorting of solid urban waste.

In this embodiment, the covering element 75 is devoid of a cover portion to be associated with the gripping portion 162 of the filtering element 60.

Another embodiment of the capsule 100 of the invention is provided, which is not shown in the figures, comprising a covering element provided with a cover portion to be superimposed and joined to the gripping portion 162 to confer greater resistance to traction and tears.

In a further embodiment of the capsule 100, not shown in the figures, it is provided that in addition to the gripping portion 162 also the annular zone of the central portion 61 is treated thermally and mechanically by hot pressure, which is fixed, in particular thermally welded, to the rim 104 of the casing 101. The non-woven material, after hot compression, becomes more easily thermally sealed to the casing of the capsule. By virtue of the reduced thickness and of the greater density of the non-woven material in the pressed portion it is in fact easier to transmit heat to the casing below to activate the sealing layer thereof.

In another embodiment of the capsule of the invention, not shown in the figures, the covering element does not comprise a cover portion to be superimposed on and joined with the gripping portion 162, but comprises a further gripping portion that is also tab-shaped and extends radially outwards, for example substantially superimposed on the gripping portion 162 of the filter element 60. The further gripping portion enables a user gripping the latter to remove separately the covering element from the filtering element 60. In this case it is thus possible to detach from the casing 101 first the covering element by means of the further gripping portion and subsequently the filtering element 60 by means of the gripping portion 162. Alternatively, the user can grasp by hand the two grasping portions and detach at the same time and separately the filtering element 60 from the casing 101 and the covering element from the filtering element 60.

Figure 7:
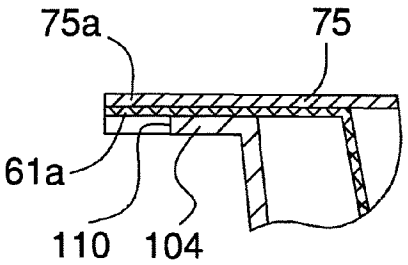
FIG. 7 is an enlarged detail of FIG. 6.
Figure 6:
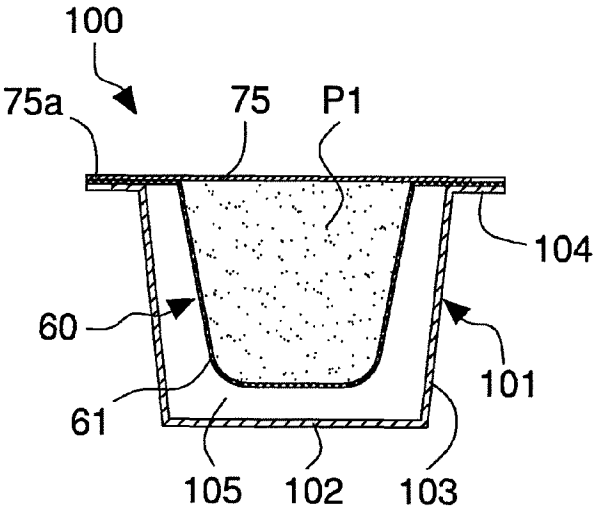
FIG. 6 is a cross section of another version of the capsule of the invention and in an assembled configuration.
Figure 8:
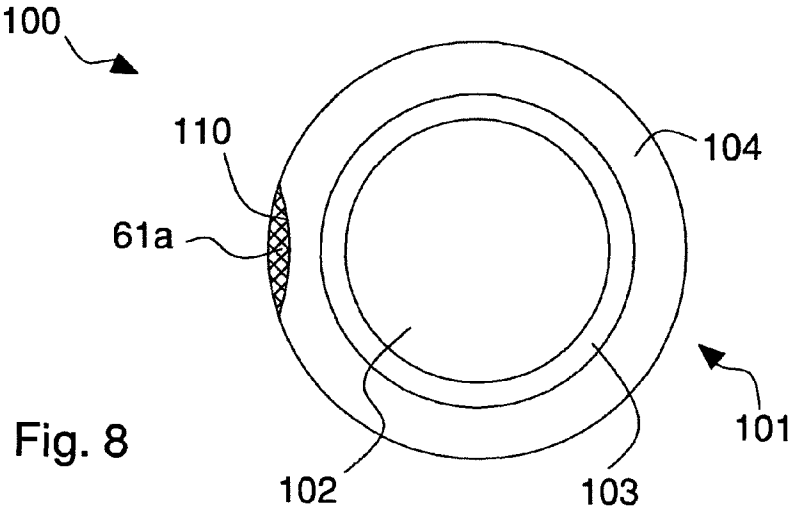
FIG. 8 is a bottom plan view of the capsule in FIG. 6.

FIGS. 6 to 8 illustrate a still another embodiment of the capsule 100 of the invention that differs from the previously disclosed embodiments through the fact that the flange rim 104 of the casing 101 comprises an indentation 110 or notch or nick arrange to discover and define the gripping portion 61*a* of the filtering element 60. The latter does not thus comprise any tab-shaped portion that extends radially from the central portion 61. Owing to the indentation 110, on the central portion 61 of the filtering element 60 a gripping portion 61*a* is defined that protrudes externally from the casing 101 and can be easily grasped by a user to detach and remove the filtering element 60 from the casing 101. In this embodiment of the capsule, the covering element 75 is provided with a cover portion 75*a* to be associated with the gripping portion 61*a* of the filtering element 60 to reinforce the latter. The cover portion 75*a* can be fixed, in particular welded, to the gripping portion 61*a*.

Alternatively or in combination, the gripping portion 61*a* of the filtering element 60 can be reinforced by hot compression so as to press and compact the fibres of the external surface layers of the non-woven material.

Figure 9:
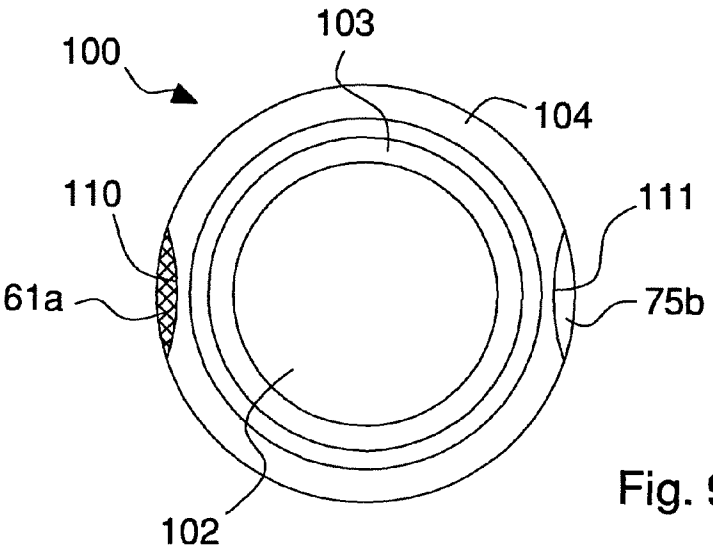
FIG. 9 is a bottom plan view of a further version of the capsule of the invention.

FIG. 9 illustrates a version of the capsule in FIG. 8 in which the rim 104 of the casing 101 and the central portion 61 of the filtering element 60 comprise further respective indentations 111 or notches or nicks that are substantially superimposed on one another and are such as to discover and define on the covering element 75 a further gripping portion 75*b* that enables a user grasping the latter to remove separately the covering element 75 from the filtering element 60. In this case it is thus possible to detach from the casing 101 first the covering element 75 by means of the further gripping portion 75*b* and subsequently the filtering element 60 by means of the gripping portion 61*a*.

The method of the invention for making a capsule 100 that is usable in a brewing machine and comprises a casing 101 provided with a cavity 105 and containing a filtering element 60 made of non-woven material arranged for receiving an initial product P1 for preparing a final product in the brewing machine, comprises the following steps:

making a filtering element 60 comprising a central portion 61 intended for containing the initial product P1 and at least one gripping portion 62, 162, 61*a;* inserting into a cavity 105 of the casing 101 the filtering element 60, the casing 101 and/or the filtering element (60) being arranged in such a manner that the gripping portion 62, 162, 61*a* protrudes from the casing 101, in particular extending externally from a rim 104 of the casing 101;

fixing the filtering element 60 to the casing 101, in particular at the rim 104 of the latter;

filling the filtering element 60 with a dose of the initial product P1;

applying and fixing a covering element 70, 75 to the casing 101, in particular to the rim 104 of the latter in such a manner as to close hermetically inside the cavity 105 the filtering element 60 and the initial product P1;

reinforcing the gripping portion 62, 162, 61*a* to enable a user grasping the latter to remove at least the filtering element 60 from the casing 101 after use.

Reinforcing comprises:

providing in the covering element 70, 75 a respective cover portion 71, 75*a* and superimposing and associating said cover portion 71, 75*a* with the gripping portion 62; 61*a* and/or hot pressing the gripping portion 162 in such a manner as to press and compact fibres of at least one external surface layer of said non-woven material and reduce a thickness of said non-woven material by a percentage comprised between 30 and 50%.

Preferably, the non-woven material in the gripping portion 162 is hot-pressed on both sides so that respective fibres of external and opposite surface layers of said non-woven material are compacted and pressed. After hot compression, the fibres are substantially alongside and brought next to one another with a substantial reduction of the passages (pores) between adjacent fibres.

It is furthermore provided that hot pressure is such as to melt, at least partially, a respective surface layer of each fibre so as to join the fibres together.

The hot pressing step of the gripping portion 162 can be made, for example, whilst the filtering element 60 is fixed, in particular thermally welded, to the casing 101.

Alternatively, the gripping portion 162 can be hot pressed in a step preceding the insertion of the filtering element 60 into the casing 101 or into a step following the step of fixing the covering element 70.

During the pressing step pressure is exerted on the defined portion of non-woven material, the pressure being comprised between 0.1 and 1.0 MPa, in particular preferably comprised between 0.2 and 0.6 MPa, at a temperature comprised between 80° C. and 250° C., in particular preferably comprised between 110° C. and 230° C. for a pressing time comprised between 0.1 and 4 s, in particular preferably comprised between 0.3 and 1 s. The pressure, temperature and compression time values vary according to the features of the non-woven material.

Experimental tests have shown that the localised hot pressing of the non-woven material leads to a reversible variation in the physical and mechanical features of said non-woven material in the aforesaid gripping portion 162.

In particular, through the effect of compacting and partial joining (partial and superficial melting) of the fibres of the surface layers of the non-woven material, in the hot-pressed gripping portion 162 it is noted, in addition to a decrease in thickness, greater density of the material, greater resistance to traction, to penetration and to cutting and less permeability to liquids. Greater resistance to traction and penetration also causes less compliance and less elastoplastic elongation of the non-woven material.

From the point of view of the external appearance, a change of colour (from opaque to shiny) is noted and a variation in consistency (increased stiffness) of the hot-pressed gripping portion 162.

The tests run on a plurality of non-woven materials with different combinations of pressure, temperature and pressure time have shown an increase in resistance to traction comprised between 70 and 100%, and an increase in resistance to static punching comprised between 60 and 90% and a decrease in permeability to liquids (ethyl alcohol) comprised between 60 and 80%.

The greater resistance to traction and the lesser compliance of the non-woven material in the hot-pressed gripping portion 162 thus enable a user to grasp the aforesaid gripping portion 162 and pull the portion 162 so as to detach and remove the filtering element 60 from the casing 101, without the risk that the aforesaid gripping portion 162 can become torn or detached from the central portion 61, fixed to the rim 104 of the casing.

The method comprises, before the step of inserting the filtering element 60, a step of thermoforming in which a sheet of thermoformable plastics is formed to make thereupon the casing 101 provided with the cavity 105.

After the step of applying the covering element 70 and/or of subjecting the gripping portion to hot pressing a cutting step can be provided for separating from the sheet of plastics the capsule 100 containing the filtering element 60 and the initial product.

Alternatively, the cutting step can be performed after the step of forming the casing 101 to separate the latter from the sheet of plastics.

The method also provides for making on the rim 104 of the casing 101 at least one indentation 110 or notch or nick to discover and define the gripping portion 61*a* of the filtering element 60.

The method also provides for making on the rim 104 of the casing 101 and on the central portion 61 of the filtering element 60 respective further indentations or notches or nicks 111 that are substantially superimposed on one another so as to discover and define on the covering element 75 a further gripping portion 75*b* that is suitable for enabling a user grasping the latter to remove separately the covering element 75 from the filtering element 60.

The invention claimed is:

1. A method for making a capsule that is usable in a brewing machine and comprises a casing provided with a cavity and containing a filtering element made of non-woven material arranged for receiving an initial product for preparing a final product in said brewing machine, said method comprising:

making a filtering element comprising a central portion intended for containing said initial product and at least one gripping portion;

inserting into said cavity said filtering element, said casing and/or said filtering element being arranged in such a manner that said at least one gripping portion protrudes from said casing;

filling said filtering element with a dose of said initial product;

fixing a covering element to said casing in such a manner as to close hermetically inside said cavity said filtering element and said initial product;

reinforcing said at least one gripping portion to enable a user grasping the latter to remove at least said filtering element from the casing after use, said reinforcing comprising:

providing in said covering element a cover portion and fixing said cover portion to said gripping portion and/or hot pressing said gripping portion in such a manner as to compact fibres of at least one external surface layer of said non-woven material and reduce a thickness of said non-woven material by a percentage comprised between 30 and 50%.

2. The method according to claim 1, wherein said hot pressing comprises pressing said fibres in such a manner that they are alongside each other and next to one another so as to reduce passages between adjacent fibres.

3. The method according to claim 1, wherein said hot pressing comprises pressing opposite sides of said non-woven material in such a manner as to compact and press respective fibres of external and opposite surface layers of said non-woven material.

4. The method according to claim 1, wherein said hot pressing comprises melting at least partially a respective surface layer of each fibre in such a manner as to join said fibres together.

5. The method according to claim 1, wherein said hot pressing comprises exerting on said gripping portion a pressure comprised between 0.1 and 1.0 MPa, and/or with a temperature comprised between 80° C. and 250° C., and/or for a time comprised between 0.1 and 4 s.

6. The method according to claim 1, wherein said fixing said cover portion comprises welding said cover portion with said gripping portion.

7. The method according to claim 1, comprising before said inserting, forming a sheet of thermoformable plastics to make thereupon at least said casing provided with said cavity.

8. The method according to claim 1, wherein said fixing said covering element to said casing comprises welding to said casing said filtering element and said covering element.

9. The method according to claim 1, wherein said hot pressing is performed before said inserting said filtering element into said casing.

10. The method according to claim 1, comprising providing in said covering element a further gripping portion to enable a user grasping the latter to remove said covering element from said filtering element.

11. The method according to claim 1, comprising making on a rim of said casing at least one indentation so as to uncover and define said gripping portion of said filtering element.

12. The method according to claim 11, comprising making on a rim of said casing and on said central portion of said filtering element respective further indentations that are substantially superimposed so as to uncover and define on said covering element a further gripping portion to enable a user grasping the latter to remove said covering element from said filtering element.

13. The method according to claim 1, further comprising the step of fixing said filtering element to said casing.

14. A capsule comprising a casing provided with a base wall and with a side wall defining a cavity that is suitable for containing a filtering element and an initial product to obtain a final product in a brewing machine, a covering element fixed to a rim of said casing to close said cavity hermetically, said filtering element comprising a central portion containing said initial product and at least one gripping portion, said casing and/or said filtering element being arranged in such a manner that said at least one gripping portion protrudes outwards from said rim, wherein, to reinforce said gripping portion and to enable a user gripping the latter to remove at least said filtering element from the casing after using the capsule said covering element comprises at least one cover portion fixed to said gripping portion and/or said gripping portion comprises at least one external surface layer of said non-woven material wherein fibres of the latter are compacted and pressed together by hot pressure and has a thickness of said non-woven material reduced by a percentage comprised between 30 and 50%.

15. The capsule according to claim 14, wherein said cover portion is fixed to said gripping portion.

16. The capsule according to claim 14, wherein the fibres of said external surface layer of said non-woven material are alongside each other and next to one another so as to reduce passages between adjacent fibres.

17. The capsule according to claim 14, wherein in said gripping portion comprises two external and opposite surface layers wherein said fibres are compacted and pressed together.

18. The capsule according to claim 14, wherein in said gripping portion respective surface layers of said fibres are at least partially melted together so as to join said fibres together.

19. The capsule according to claim 14, wherein said covering element comprises a further gripping portion to enable a user grasping the latter to remove said covering element from said filtering element.

20. The capsule according to claim 14, wherein said rim comprises at least one indentation arranged for uncovering and defining said gripping portion of said filtering element.

21. The capsule according to claim 20, wherein said rim of said casing and said central portion of said filtering element comprise respective further indentations that are substantially superimposed and such as to uncover and define on said covering element a further gripping portion to enable a user grasping the latter to remove said covering element from said filtering element separately.

* * * * *